US009534757B2

(12) United States Patent
Kang

(10) Patent No.: US 9,534,757 B2
(45) Date of Patent: Jan. 3, 2017

(54) LAMP FOR VEHICLE

(71) Applicant: HYUNDAI MOBIS CO., LTD., Seoul (KR)

(72) Inventor: Dong Gon Kang, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 78 days.

(21) Appl. No.: 14/217,049

(22) Filed: Mar. 17, 2014

(65) Prior Publication Data

US 2015/0029739 A1 Jan. 29, 2015

(30) Foreign Application Priority Data

Jul. 25, 2013 (KR) ..... 10-2013-0088067

(51) Int. Cl.
*F21V 9/16* (2006.01)
*F21S 8/10* (2006.01)
*F21V 3/04* (2006.01)

(52) U.S. Cl.
CPC ..... *F21S 48/1225* (2013.01); *F21S 48/1131* (2013.01); *F21S 48/1145* (2013.01); *F21S 48/1154* (2013.01); *F21S 48/1258* (2013.01); *F21V 3/0463* (2013.01); *F21V 3/0481* (2013.01); *F21V 9/16* (2013.01)

(58) Field of Classification Search
CPC ... F21S 48/115; F21S 48/1154; F21S 48/1159; F21S 48/1163; F21S 48/1131; F21S 48/1145; F21S 48/1258; F21S 48/1225; F21V 9/16; F21V 3/0463; F21V 3/0481
See application file for complete search history.

(56) References Cited

U.S. PATENT DOCUMENTS 7,052,152 B2 * 5/2006 Harbers ..... G02F 1/133603 349/71
2011/0121732 A1 * 5/2011 Tsutsumi ..... F21S 48/1159 315/77
2012/0287658 A1 * 11/2012 Tanaka ..... F21S 48/1109 362/516
2012/0294025 A1 * 11/2012 Kim ..... H01L 33/46 362/516

(Continued)

FOREIGN PATENT DOCUMENTS

CN 102798060 A 11/2012
EP 2216585 A1 8/2010
KR 10-2012-0128909 A 11/2012

OTHER PUBLICATIONS

Chinese Office Action dated Feb. 29, 2016 of corresponding Chinese patent application No. 201410159254.8—6 pages.

*Primary Examiner* — Alan Cariaso
(74) *Attorney, Agent, or Firm* — Knobbe Martens Olson & Bear LLP

(57) ABSTRACT

The present invention provides a lamp for a vehicle, including: a light source assembly in which a plurality of light sources, which produces a blue beam, is provided; and an upper substrate which is made of a transparent material that transmits light, is provided to cover upper portions of the light sources, and has one side surface on which a phosphor film is formed, and as a result, a dark zone on a beam pattern, which occurs due to a distance between the light sources in the lamp in which the plurality of light sources is mounted, may be eliminated.

5 Claims, 8 Drawing Sheets

(56) References Cited

U.S. PATENT DOCUMENTS

| | | | | |
|---|---|---|---|---|
| 2013/0015478 | A1* | 1/2013 | Oh | F21S 48/1154 257/98 |
| 2014/0071655 | A1* | 3/2014 | Wang | F21K 9/56 362/84 |
| 2014/0362600 | A1* | 12/2014 | Suckling | F21S 48/1145 362/583 |

* cited by examiner

LAMP FOR VEHICLE

CROSS-REFERENCE TO RELATED APPLICATIONS

This application claims priority to and the benefit of Korean Patent Application No. 10-2013-0088067 filed in the Korean Intellectual Property Office on Jul. 25, 2013, the entire contents of which are incorporated herein by reference.

TECHNICAL FIELD

The present invention relates to a lamp for a vehicle, and more particularly, to a lamp for a vehicle which may eliminate a dark zone that occurs due to a distance between light sources in the lamp for a vehicle in which a plurality of light sources is disposed in parallel.

BACKGROUND ART

In general, a lamp is a device that generates light by being supplied with electric power from a battery or the like, and a lamp for a vehicle, which is installed in a vehicle, emits light forward so as to secure a visual field in front of a driver.

Typically, as a light source of the lamp for a vehicle, a halogen lamp or a gas discharge lamp has been mainly used. However, recently, a light emitting diode (LED), which has less electric power consumption and excellent brightness, is widely used as a light source.

Recently, as a method of implementing a glare free high beam, an optical system, which adopts a multi-array LED and an aspherical lens, has been developed.

FIG. 1 is a perspective view illustrating a multi-array LED optical system in the related art, and FIG. 2 is a perspective view illustrating a lower substrate of FIG. 1.

Referring to FIG. 1, the multi-array LED optical system in the related art includes a lower substrate on which a plurality of LEDs is mounted, and an aspherical lens which transmits light emitted from the LEDs forward.

In a case in which the plurality of LEDs is provided on the lower substrate in the multi-array LED optical system, a plurality of LED chips needs to be electrically insulated, and thus a gap g between the LED chips is necessarily needed, as illustrated in FIG. 2.

Since the gap g is formed between the LED chips, the gap g between the LED chips is shown as a dark zone in a road surface image of a real lamp. Accordingly, there are problems in that marketability of the lamp deteriorates, and the lamp causes eye fatigue to a driver.

SUMMARY OF THE INVENTION

The present invention has been made in an effort to provide a lamp for a vehicle which may eliminate a dark zone on a beam pattern which occurs due to a distance between light sources in the lamp in which the plurality of light sources is mounted.

An exemplary embodiment of the present invention provides a lamp for a vehicle, including: a light source assembly in which a plurality of light sources is provided; and an upper substrate which is made of a transparent material that transmits light, is provided to cover upper portions of the light sources, and has one side surface on which a phosphor film is formed.

The light source may be provided as an LED chip.

The light source may produce a blue beam, and the phosphor film may be formed using a yellow phosphor.

A distance between the light source and the phosphor film may be set to a position where light, which is diffused with intensity that is 0.47 to 0.54 times the intensity of light emitted from the light source, reaches the phosphor film at an intermediate point of the light sources.

A distance between the light source and the phosphor film may be within a range of the following numerical formula, $$1.56 < \frac{a}{2b} < 1.88$$

in which a refers to a distance between the plurality of light sources, and b refers to the distance between the light source and the phosphor film.

The lamp may further include a lens which is provided in front of the light source assembly, and transmits forward light emitted from the light source.

The lens may be an aspherical lens.

According to the lamp for a vehicle of the present invention, a dark zone on a beam pattern, which occurs due to a distance between the light sources in the lamp in which the plurality of light sources is mounted, may be eliminated.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
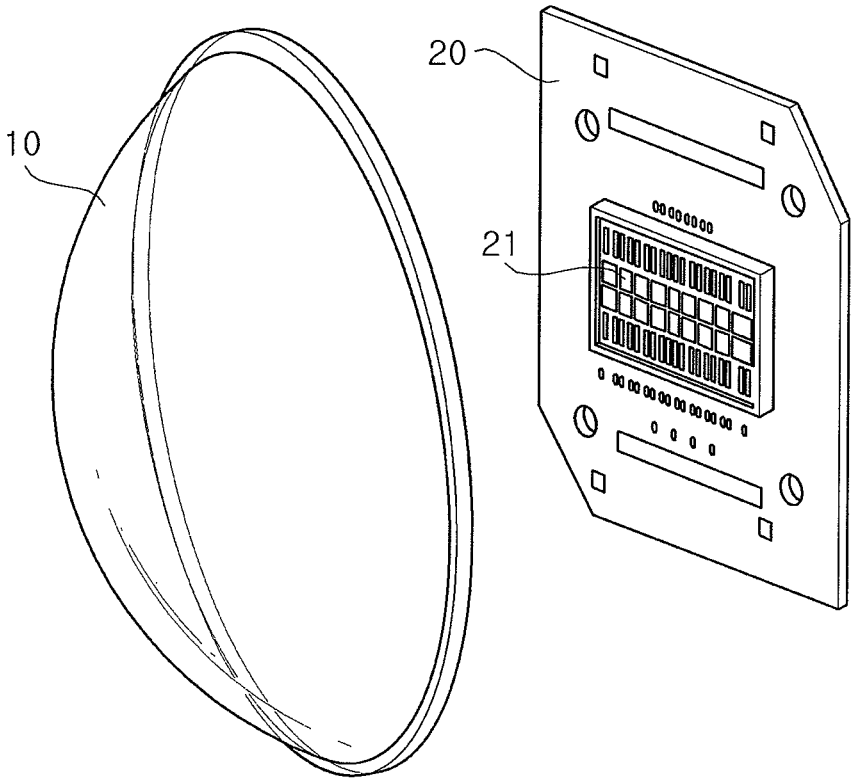
FIG. 1 is a perspective view illustrating a multi-array LED optical system in the related art.
Figure 2:
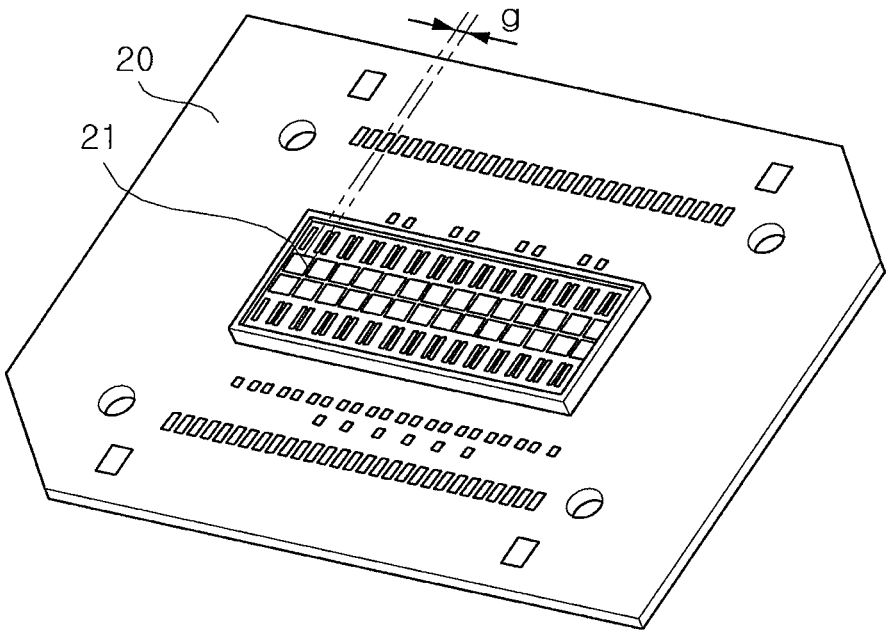
FIG. 2 is a perspective view illustrating a lower substrate of FIG. 1.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, an exemplary embodiment of the present invention will be described in detail with reference to the accompanying drawings. First, in denoting reference numerals to constituent elements of respective drawings, it should be noted that the same elements will be designated by the same reference numerals although they are shown in different drawings. Hereinafter, an exemplary embodiment of the present invention will be described, but, of course, the technical spirit of the present invention is not restricted or limited thereto, but the exemplary embodiment of the present invention may be modified by a person with ordinary skill in the art to be variously performed.

Figure 3:
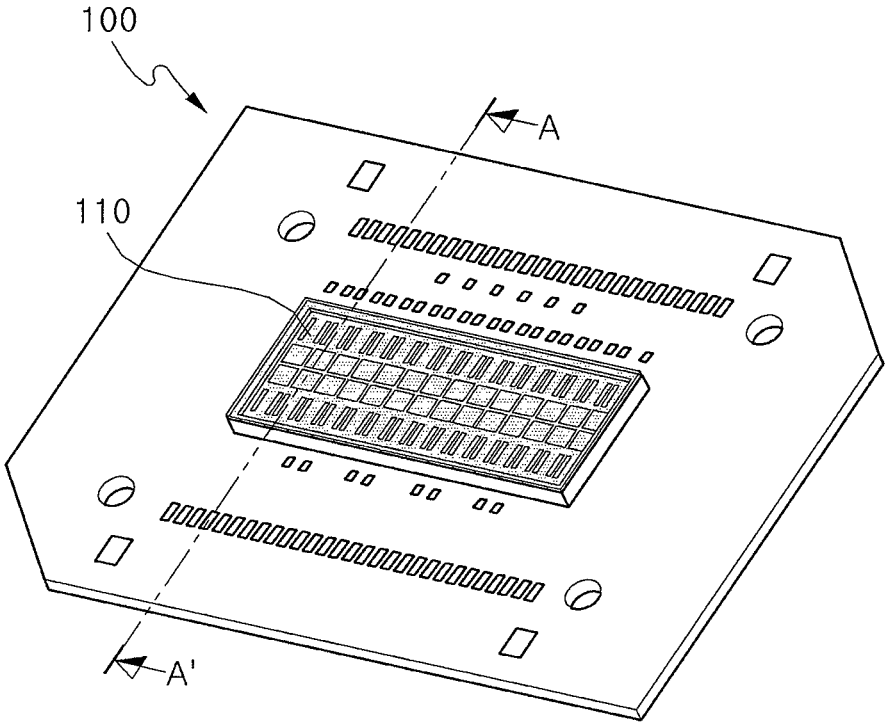
FIG. 3 is a perspective view illustrating a light source assembly of a lamp for a vehicle according to an exemplary embodiment of the present invention.
Figure 4:
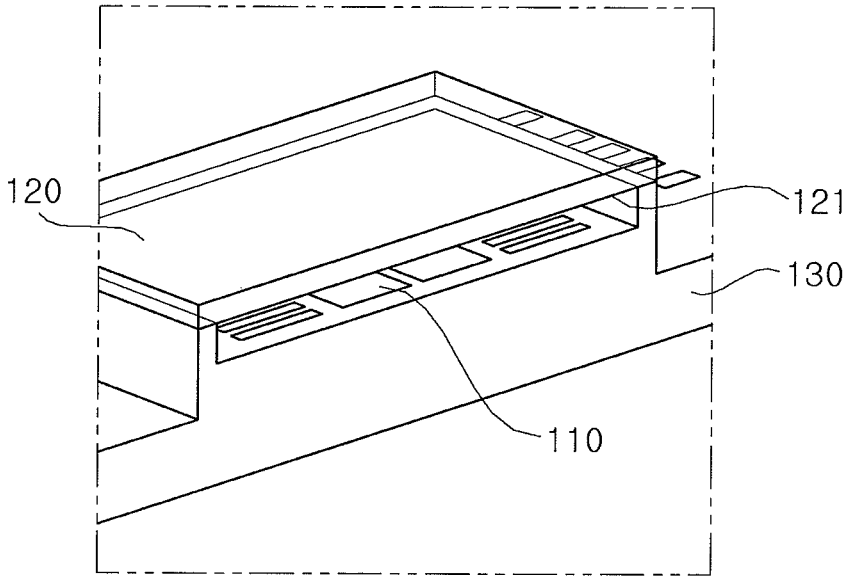
FIG. 4 is a cross-sectional perspective view taken along line A-A' of FIG. 3.
Figure 5:
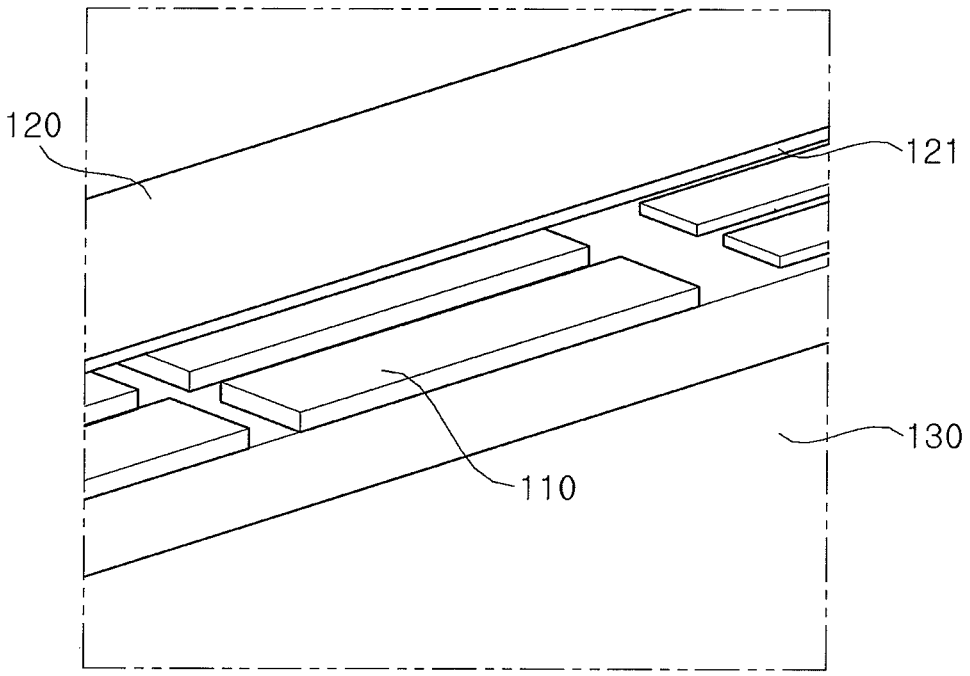
FIG. 5 is an enlarged perspective view illustrating a main part of FIG. 4.
Figure 6:
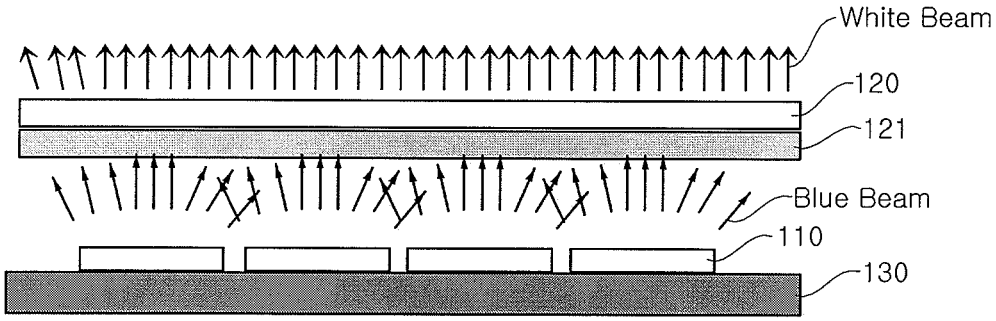
FIG. 6 is a schematic view illustrating a path along which light is emitted from the light source assembly of FIG. 3.
Figure 7:
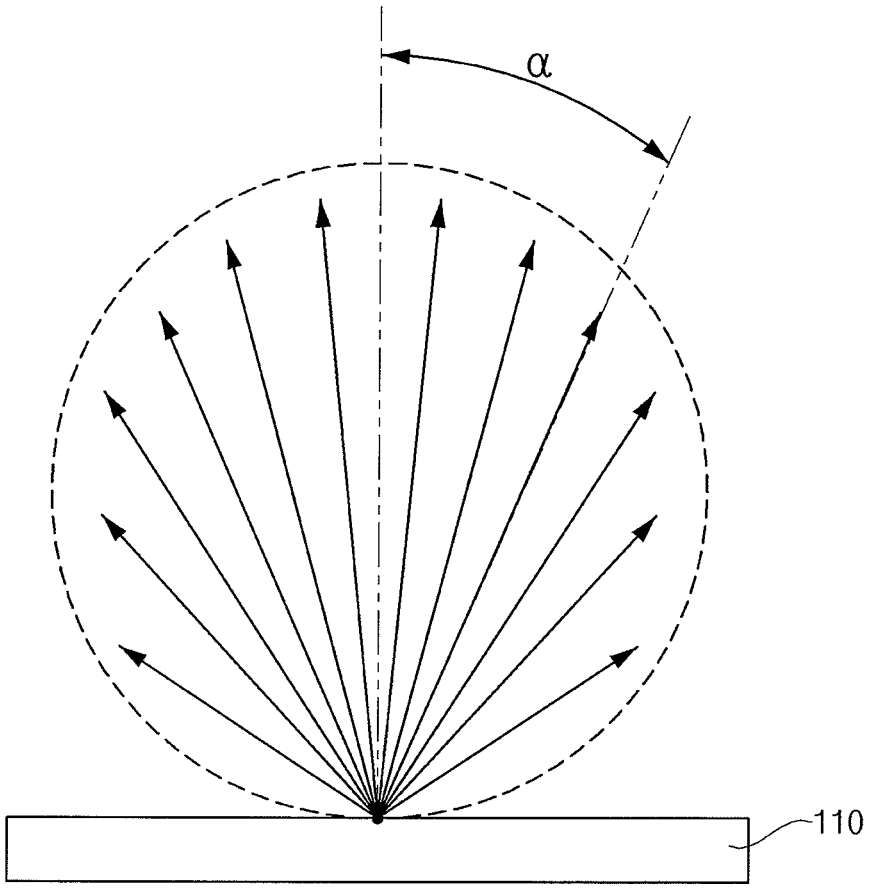
FIG. 7 is a view illustrating intensity of light that is diffused at the light source of FIG. 3.
Figure 8:
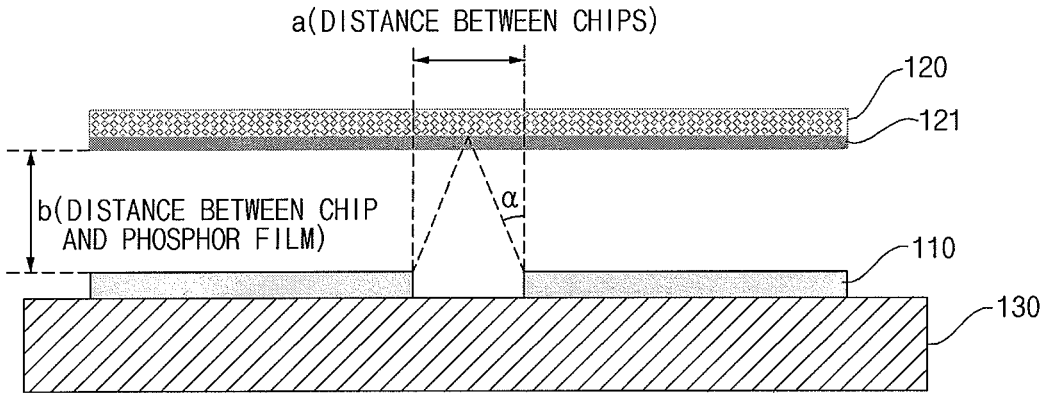
FIG. 8 is a view for explaining a principle of calculating a distance between the light source and a phosphor film so as to minimize a dark zone.

FIG. 3 is a perspective view illustrating a light source assembly of a lamp for a vehicle according to an exemplary embodiment of the present invention, FIG. 4 is a cross-sectional perspective view taken along line A-A' of FIG. 3, FIG. 5 is an enlarged perspective view illustrating a main part of FIG. 4, FIG. 6 is a schematic view illustrating a path along which light is emitted from the light source assembly of FIG. 3, FIG. 7 is a view illustrating intensity of light that is diffused at the light source of FIG. 3, and FIG. 8 is a view for explaining a principle of calculating a distance between the light source and a phosphor film so as to minimize a dark zone.

FIGS. 3 to 8 clearly illustrate only main characteristic parts for conceptual and clear understanding of the present invention. As a result, various modifications to the illustrations are expected, and the scope of the present invention does not have to be limited to specific shapes illustrated in the drawings.

Referring to the drawings, a lamp for a vehicle according to an exemplary embodiment of the present invention includes a light source assembly 100 which has a plurality of light sources that produces a blue beam, and an upper substrate 120 which is made of a transparent material that transmits light, is provided to cover upper portions of the light sources, and has one side surface on which a phosphor film 121 is formed.

The light source assembly 100 includes a lower substrate 130, and the plurality of light sources which is installed on the lower substrate 130 at predetermined intervals.

In the present exemplary embodiment, the light sources are provided as LED chips 110.

The plurality of LED chips 110 is installed in one region of the lower substrate 130 at predetermined intervals, and in this case, the predetermined interval are necessarily formed between the respective LED chips 110 in order to insulate each LED chip 110. Due to the gap between the LED chips 110, a dark zone is formed on a road surface image of a beam pattern. In the present invention, in order to eliminate the dark zone, a separate phosphor film 121 is disposed separately from the LED chips 110 such that while the interval between the LED chips 110 is maintained, light emitted from the LED chips 110 becomes fluorescent by the phosphor film 121 and is emitted, thereby preventing the occurrence of the dark zone.

A blue LED chip 110, which produces a blue beam, is used as the light source, and the phosphor film 121 is formed by using a yellow phosphor, such that the blue beam radiating from the LED chip 110 is mixed with a yellow beam produced from the phosphor film 121, thereby implementing a white beam, as illustrated in FIG. 6.

The upper substrate 120 is provided to cover the entirety of the upper portions of the plurality of LED chips 110, and has one side surface on which the phosphor film 121 is formed.

Referring to FIGS. 4 and 5, the upper substrate 120 is made of a transparent glass or plastic material, and one side surface adjacent to the LED chips 110 is coated with the yellow phosphor so as to form the yellow phosphor film 121.

The phosphor absorbs the light emitted from the LED chip 110 so as to generate fluorescence, and thus the light is emitted forward through the phosphor film 121 without producing the dark zone. FIG. 6 illustrates a schematized view of the aforementioned principle.

According to the aforementioned configurations, in the optical system in which the plurality of LED chips 110 is disposed, the problem with the occurrence of the dark zone between the LED chips 110 may be resolved. Even in a case in which technologies are not sufficient to narrow the interval between the plurality of LED chips 110 that is mounted on the lower substrate 130, there is an effect in that road surface performance of the lamp for a vehicle may be made excellent by applying the configurations of the present invention.

Meanwhile, hereinafter, a process of calculating a distance between the LED chips 110 and the phosphor film 121 in order to effectively eliminate the dark zone will be described.

Referring to FIG. 7, the light emitted from the LED chips 110 is diffused while having lambertian distribution.

As illustrated in FIG. 7, intensity of light, which is diffused in a direction that is spaced apart from a forward direction of the emitted light by an angle of $\alpha$, may be represented by $I(\alpha)=I_0\cdot\cos(\alpha)$. That is, the intensity of the light, which is diffused at the angle of $\alpha$ from the forward direction, is a value that is produced by multiplying the intensity $I_0$ of the forward directional light by $\cos(\alpha)$ value.

In order to minimize the dark zone between the LED chips 110 by arranging the LED chips 110 having the aforementioned diffusion distribution, it was proved through experiments that it is most effective when the phosphor film 121 is disposed at a position c where light, which is diffused with intensity that is 0.47 to 0.54 times the intensity of the forward directional light emitted from the LED chips 110, reaches the phosphor film 121 at an intermediate point of the gap between the two LED chips 110.

In FIG. 8, since the intensity of the light, which reaches the position c, is $I_0\cdot\cos\alpha$, the $\cos\alpha$ value needs to be in the range from 0.47 to 0.54 so as to satisfy a condition for minimizing the dark zone.

Referring to FIG. 8, when the interval between the LED chips 110 refers to a, and the distance between the LED chip 110 and the phosphor film 121 refers to b, $$\alpha = \tan^{-1}\left(\frac{a}{2b}\right),$$

and thus, when a numerical formula of $$0.47 < \cos\left(\tan^{-1}\left(\frac{a}{2b}\right)\right) < 0.54$$

is satisfied, the occurrence of the dark zone may be minimized.

The inequalities are represented by the following Numerical Formula 1

$$1.56 < \frac{a}{2b} < 1.88 \qquad \text{[Numerical Formula 1]}$$

In Numerical Formula 1, a refers to the interval between the LED chips 110, and b refers to the distance between the LED chip 110 and the phosphor film 121.

When the interval between the LED chips 110 is determined by Numerical Formula 1, the distance between the LED chip 110 and the phosphor film 121, which may effectively eliminate the dark zone, may be calculated.

In general, in order to produce a white LED chip, a yellow phosphor film is formed at an upper end of the blue LED chip. Defects occur in large numbers during a process of forming the phosphor film, and all the LED chips having defects need to be discarded. Defects of the LED chip hardly occur in the current process, and most of defects occur during a process of forming the phosphor film.

In the present invention, the LED chip 110 and the phosphor film 121 are separately formed, such that even in a case in which defects occurs during the process of forming the phosphor film 121, only the phosphor film 121 may be discarded and then remanufactured, thereby markedly reducing a level of defectiveness during a manufacturing process.

Meanwhile, the lamp for a vehicle of the present exemplary embodiment further includes a lens (not illustrated) which is provided in front of the light source assembly 100, and transmits forward the light emitted from the light source. In the present exemplary embodiment, the lens is provided as an aspherical lens.

As such, according to the lamp for a vehicle of the present invention, a dark zone on a beam pattern, which occurs due to a distance between the light sources in the lamp in which the plurality of light sources is mounted, may be eliminated.

There is an effect of markedly reducing a level of defectiveness during a process of manufacturing the LED chip.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A lamp for a vehicle, comprising:

a substrate having a major surface;

a plurality of light sources provided over the major surface of the substrate, the plurality of light sources including a first light source and a second light source that are separated from each other by a first distance (A) when viewed in a direction perpendicular to the a major surface with no intervening light source therebetween, the first light source and the second light source being configured to emit a Lambertian pattern of light emission having a surface normal direction that is parallel to the direction; and a phosphor layer is formed over the plurality of light sources, wherein the phosphor layer is separated from the plurality of light sources by a second distance (B) in the direction to meet the following formula, $$1.56 < \frac{A}{2B} < 1.88$$

such that, at the midpoint between the first and second light sources when viewed in the direction, the phosphor layer receives light from the first light source and the second light source respectively at an intensity of 0.47 to 0.54 times of emission intensity of the Lambertian pattern in the surface normal direction.

2. The lamp of claim 1, wherein the plurality of light sources are provided as an array of LED chips.

3. The lamp of claim 1, wherein the plurality of light sources emit a blue beam, and the phosphor layer includes a yellow phosphor.

4. The lamp of claim 1, further comprising: a lens formed over the plurality of light sources, and configured to transmit forward light emitted from the plurality of light sources.

5. The lamp of claim 4, wherein the lens is an aspherical lens.

* * * * *